US005800640A

United States Patent [19]

Yamamoto et al.

[11] Patent Number: 5,800,640

[45] Date of Patent: Sep. 1, 1998

[54] METHOD OF PRODUCING A LIGHT ALLOY PRODUCT

[75] Inventors: Yukio Yamamoto; Makoto Fujita; Nobuo Sakate; Katsuya Ohuchi; Shoji Hirabara, all of Hiroshima-ken, Japan

[73] Assignee: Semiconductor Energy Laboratory Co., Ltd., Kanagawa, Japan

[21] Appl. No.: 843,455

[22] Filed: Apr. 16, 1997

Related U.S. Application Data

[62] Division of Ser. No. 603,201, Feb. 20, 1996, Pat. No. 5,693,158, which is a continuation of Ser. No. 195,454, Feb. 14, 1994, abandoned.

[30] Foreign Application Priority Data

| | | | |
|---|---|---|---|
| Feb. 12, 1993 | [JP] | Japan | 5-024114 |
| Feb. 19, 1993 | [JP] | Japan | 5-054985 |
| Feb. 7, 1994 | [JP] | Japan | 6-013629 |

[51] Int. Cl.[6] ..... C22F 1/06

[52] U.S. Cl. ..... 148/557; 29/527.5; 148/667

[58] Field of Search ..... 148/557, 406, 148/420, 667; 420/402, 409; 29/527.5

[56] References Cited

U.S. PATENT DOCUMENTS

| | | | |
|---|---|---|---|
| 3,936,298 | 2/1976 | Mehrabian et al. | 148/400 |
| 5,143,564 | 9/1992 | Gruzleski et al. | 148/420 |
| 5,223,215 | 6/1993 | Charbonnier et al. | 420/407 |

FOREIGN PATENT DOCUMENTS

| | | |
|---|---|---|
| 51-120953 | 10/1976 | Japan . |
| 62-25464 | 6/1987 | Japan . |

*Primary Examiner*—Peter Chin
*Assistant Examiner*—Sean Vincent
*Attorney, Agent, or Firm*—Sixbey, Friedman, Leedom & Ferguson, P.C.; Gerald J. Ferguson, Jr.; Jeffrey L. Costellia

[57] ABSTRACT

This invention relates to a method for producing a magnesium light alloy product. In order to enhance formability in plastically forming a magnesium alloy material and obtain high tensile strength and high proof stress in the final product, the magnesium alloy material is cast by using molten magnesium alloy containing strontium of 0.02 to 0.5 weight percent and then plastically formed into a magnesium light alloy product in set shape.

10 Claims, 17 Drawing Sheets

METHOD OF PRODUCING A LIGHT ALLOY PRODUCT

This is a Divisional application of Ser. No. 08/603,201, filed Feb. 20, 1996, now U.S. Pat. No. 5,693,158; which itself is a Continuation of Ser. No. 08/195,454, filed Feb. 14, 1994, abandoned.

BACKGROUND OF THE INVENTION

This invention relates to a light alloy product and a method of producing the same.

There have been developed various kinds of techniques for casting an automobile wheel, suspension elements (such as a lower arm, an upper arm, a link, a bracket) and the like by the use of light alloy material such as aluminum alloy and magnesium alloy.

As commonly known, magnesium alloy is used for working (including plastic working such as forging), casting and the like. Recently, it is designed to apply the magnesium alloy to products, such as an automobile wheel, which require to have light weight, high tensile strength and high proof stress.

Al, Mn, Zn and the like are generally used as elements for magnesium alloy. There have been commonly known in casting technique that: adding aluminum to magnesium enhances strength of magnesium alloy and presents grain refinement in the cast structure; adding a little amount of manganese to magnesium enhances corrosion resistance and strength due to the grain refinement; and adding a little amount of zinc to magnesium enhances mechanical properties of the magnesium alloy. For the grain refinement of the cast structure in magnesium alloy, there have been further known techniques of adding a little amount of zirconium and inoculating with carbon, $FeCl_3$ or the like.

Furthermore, there has been well known a method of producing a metal product in which material is cast in the similar form to a product and then forged (refer to Japanese Patent Application Open Gazette No.51-120953). In case of forging material from ingot to form a product, there have been generally required many forging steps from a rough-forging step to a finish-forging step. In the above method, however, forging steps are reduced because materials are previously cast in the similar form to the product before they are forged.

When casting is combined with forging in the above manner, the forging steps are simplified. However, even if the method is applied to a method of producing a magnesium light alloy product, the forged material cannot obtain satisfactory tensile strength and proof stress because of the limit of forging rate of magnesium alloy material.

The grain refinement of the cast structure is effective on improvement of plastic formability including forgeability and presents enhancements of tensile strength and proof stress. However, conventional measures of adding alloy elements such as Al, Mn and Zn to magnesium have limitations in improvement of the formability due to the grain refinement of the cast structure.

Among various kinds of casting methods, attention has been recently paid to a half-melting casting method in which alloy material is heated and melted in a half-melted state and then formed by solidification.

According to this method, cast material having relatively high formability can be obtained. However, in molten alloy merely made in a half-melted state, solid phase part in the molten alloy remains dendrite, thereby reducing fluidity of the cast structure at the formation. This involves low working limit and insufficient formability.

To cope with the above problem, there has been proposed a method of producing a light alloy product, as disclosed in Japanese Patent Publication Gazette No.62-25464, in which dendrite in molten alloy is fractured by magnetically stirring the molten alloy.

However, even by the above method using the magnetical stirring, the dendrite cannot be sufficiently fractured. Thus, working limit is still low and sufficient formability cannot be achieved.

Furthermore, when a magnesium light alloy product is used as an application such as an automobile wheel which is exposed to the open air, higher corrosion resistance are required.

SUMMARY OF THE INVENTION

This invention has its object of providing a light alloy product having excellent plastic formability, high tensile strength, high proof stress and high corrosion resistance.

Further, this invention has another object of providing a method suitable for producing such a light alloy product.

Inventors have made efforts in order to overcome the above problems. As a result, they found that: when a set amount of strontium is used as an element for magnesium alloy, the cast structure is refined due to the strontium thereby increasing formability in plastic working; in particular, when strontium is included, at a large amount over a certain extent, in the magnesium alloy, the strontium itself contributes to improvement of the formability because of a different reason from the grain refinement; even when the strontium content of magnesium alloy is relatively small, for example, on condition that a solidification speed (cooling speed) at the casting is high, the cast structure is gradually refined from the surface towards the inside of casting products in accordance with increase of the strontium content; a magnesium light alloy product enhances its corrosion resistance by including strontium; and when light alloy material is stirred in a half-melted state thereof, dendrite is fractured to turn into spheres. Based on the foregoing findings, this invention has been realized.

Accordingly, a magnesium light alloy product of the present invention has a feature of comprising strontium of 0.02 to 0.5 weight percent.

Further, a method suitable for obtaining the magnesium alloy product has a feature of comprising the steps of casting a magnesium alloy material by using molten magnesium alloy containing strontium of 0.02 to 0.5 weight percent and then plastically forming the cast magnesium alloy material into a magnesium light alloy product in set shape.

According to the method of obtaining the magnesium alloy product by plastically forming the magnesium alloy material cast from the molten magnesium alloy, the strontium contributes to grain refinement of the cast structure and enhances formability in plastic forming. That is, although the grain refinement presents improvement of formability, a grain refinement effect of strontium is saturated when the strontium content of the alloy material reaches to approximately 0.02 weight percent. However, on condition that the solidification speed at the casting is high, the cast structure is further refined according to increase of the strontium content, even if the strontium content is over 0.02 weight percent. In this case, particularly, the grain refinement reaches to not only the vicinity of surface of the alloy material but also the inside thereof (This will become apparent in the below-mentioned embodiment).

In this invention, such a strontium content of the magnesium alloy is set to more than 0.02 weight percent, thereby enhancing grain refinement of the cast structure and formability in plastic forming. This presents high tensile strength and high proof stress. In addition, the magnesium alloy product increases its corrosion resistance according to increase of the strontium content (This will also become apparent in the below-mentioned embodiment).

As understood from the above, the lowest limit of the strontium content in this invention is set to 0.02 weight percent in order to enhance the grain refinement effect of the strontium when the magnesium light alloy product is obtained by the casting and the plastic forming and in order to obtain a desired effect of enhancing mechanical properties of the magnesium light alloy product.

Further, the reason why the highest limit of the strontium content in this invention is 0.5 weight percent is that when the limit is higher, compound is made between the strontium and magnesium, aluminum, zinc or the like thereby having a bad influence on mechanical properties of the light alloy product and it becomes difficult to cast the magnesium alloy material.

Preferably, the strontium content is set within a range from 0.1 to 0.2 weight percent. Setting the strontium content to more than 0.1 weight percent presents high plastic formability and improved mechanical properties, even if the solidification speed at the casting is insufficient, as compared with the case that the strontium content is small (This will also become apparent in the below-mentioned embodiment). Although the reason is not obvious, it can be understood that the strontium contributes to enhancement of formability because of not only the grain refinement effect thereof but also another effect due to the use of a large amount thereof. That is, it can be understood that the strontium existing at high density in the vicinity of grain boundary of the magnesium alloy reinforces the grain boundary thereby restraining cracks from generating in the grain boundary at the forming.

The reason why the highest limit of the strontium content is preferably set to 0.2 weight percent is that since strontium is very expensive, enhancement of material properties should be compatible with economy.

At the casting, containing the above strontium into magnesium alloy by means of adding the strontium to molten magnesium alloy is preferable to forming molten alloy by means of melting magnesium alloy material containing the strontium. This enhances the above effects of strontium.

Further, in the casting step, it is preferable to regulate the strontium content so that an average grain diameter of the magnesium alloy material is below 200 μm. The reason for this is that when the average grain diameter is below 200 μm, forgeability of the material is enhanced.

Furthermore, it is preferable to apply forging as plastic forming of the magnesium alloy material. This has the advantage of obtaining grain refinement, high strength and high toughness by executing subsequent heat treatments, (i.e., a solution treatment and a following artificial aging treatment). Accordingly, executing the heating treatments after the forging is a further preferable measure to attain the objects of the present invention.

Another method for obtaining a light alloy product according to this invention comprises the steps of: stirring light alloy material in a half-melted state; diecasting the light alloy material in a half-melted state to form a cast material; and then plastically forming the cast material to form a light alloy product.

According to the above method, since light alloy material is stirred in a half-melted state, dendrite of solid phase in molten alloy is fractured to turn into small spheres with grain diameter. Accordingly, a material obtained by casting the molten alloy has a fine structure and a light alloy product obtained by plastically forming the cast material have improved working limit and sufficient formability.

In the above method, forging is applicable as plastic forming. By the use of forging, the improved working limit and the sufficient formability can be outstandingly displayed.

Preferably, magnesium light alloy material may be used as the light alloy material and stirred in a half-melted state of solid-phase rate of 25 to 60%.

A light alloy product obtained by the use of the material having a solid-phase rate of more than 25% as shown in FIG. 19, has sufficiently improved working limit, as compared with a light alloy product obtained by the use of material having a solid-phase rate of 0% (that is, material with liquid-phase rate of 100% which is obtained by normal melting casting method). Further, a cast material obtained by the half-melting casting method excels one obtained by the conventional casting method in mechanical properties. Accordingly, when the cast material by the half-melting casting method is forged, it performs further excellent mechanical properties by one time forging, in cooperation with enhanced formability. Consequently, the number of working processes is reduced.

It is further preferable to stir the magnesium alloy material in a half-melted state of solid-phase rate of 25 to 60% and then conduct heat treatments (that is, a solution treatment and an artificial aging treatment) to the forged material.

When the magnesium alloy material is stirred in a half-melted state of solid-phase rate of 25 to 60% as mentioned above, dendrite of solid state in molten alloy is fractured to turn into small spheres of grain diameter. Accordingly, a light alloy product, which has been obtained by casting the molten alloy, forging the cast material and conducting the heat treatments to the forged material, has outstandingly improved working limit, sufficient formability, high mechanical strength and high toughness.

Objects, advantages and features of this invention will become more apparent from the following description of embodiment thereof when read in connection with the accompanying drawings.

DESCRIPTION OF THE PREFERRED EMBODIMENT

Description is made below about an embodiment of the present invention with reference to the accompanying drawings.

First, there will be discussed influences which strontium content of a magnesium light alloy product has on mechanical properties or the like thereof.

As magnesium light alloy products respectively containing set amounts of strontium, Samples 1 to 5 were produced and compared in its mechanical properties or the like with one another.

SAMPLE 1

A magnesium alloy material was cast by the use of magnesium alloy A having the following chemical components: 8.6 weight % aluminum, 0.58 weight % zinc, 0.50 weight % manganese, 0.10 weight % strontium, and magnesium as the remainder.

Figure 1:
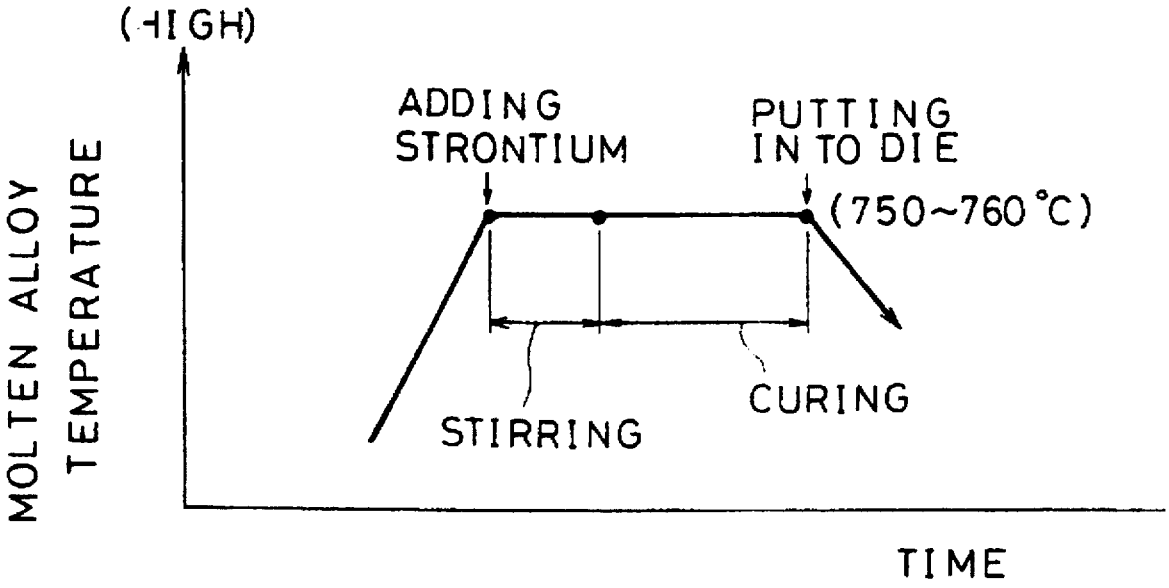
FIG. 1 shows a time chart of a molten metal treatment at casting of material.

In the above casting process, temperature of molten alloy was set to 750° to 760° C. and temperature of a preheated die was set to 210° to 230° C. As shown in FIG. 1, the strontium was mixed in such a manner that alloy composed of 90% strontium and 10% aluminum was added at an amount as the strontium shows the above component rate of the magnesium alloy A. After the strontium was added, the molten alloy was stirred for ten minutes with keeping the above set temperature, cured for fifteen minutes and then cast. An average grain diameter of the magnesium alloy material obtained by casting was 115 to 180 μm (in detail, 115 μm in the vicinity of surface of the material and 180 μm at the center of the material).

Figure 2:
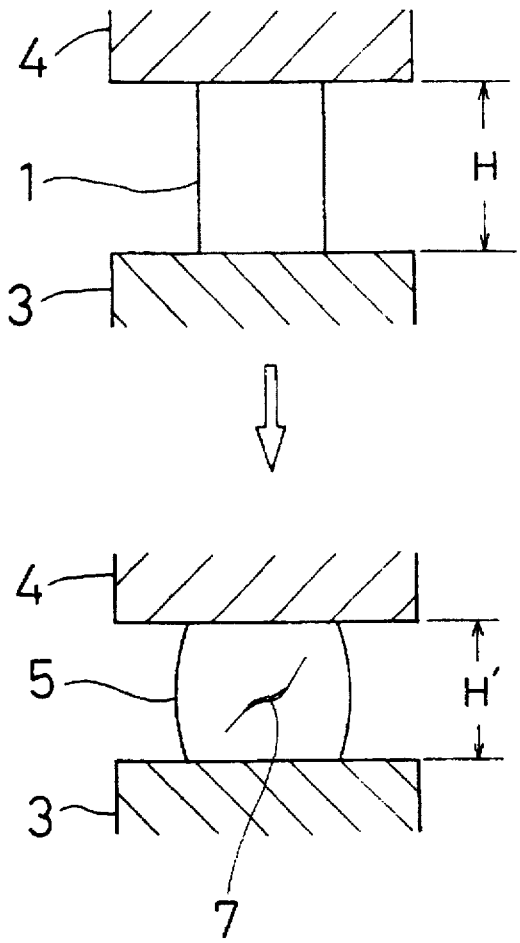
FIG. 2 is a sectional view showing the form of material preceding forging and a forged material.

Then, as shown in FIG. 2, the magnesium alloy material was forged (plastically formed). In the Figure, 1 indicates the magnesium alloy material (hereafter referred to as Sample 1), 3 indicates a die, 4 indicates a punch, and 5 indicates a forged material. In the forging, material temperature was set to 350° C. A forging rate defined by the below formula (1) was 50%. The formula is:

$$\textit{Forging rate}=\{(H-H')/H\}\times 100 \quad (1)$$

In the above formula, H and H' indicate respective heights of Sample 1 in a forging direction at times before and after the forging (see FIG. 2).

Further, also forging limit was measured. A forging rate at the time when Sample 1 generated a crack 7 was set to the forging limit.

Then, heat treatments were conducted to obtained forged material 5. That is, the forged material 5 was first subjected to a solution treatment at 413°±2.5° C. for sixteen hours and then air-cooled. Subsequently, the forged material 5 was subjected to an artificial aging treatment at 175°±2.5° C. for sixteen hours and then air-cooled.

SAMPLE 2

A magnesium alloy material (hereafter referred to as Sample 2) was cast by the use of the magnesium alloy A in the same manner as in Sample 1 and forged so as to be a forging rate of 65%. Then, obtained forged material was subjected to the same heat treatments as in Sample 1.

SAMPLE 3

A magnesium alloy material (hereafter referred to as Sample 3) was cast by the use of magnesium alloy B having the following chemical components: 8.6 weight % aluminum, 0.58 weight % zinc, 0.50 weight % manganese, 0.02 weight % strontium and magnesium as the remainder. Sample 3 is different from Sample 1 in that the strontium content is 0.02 weight % and that no forging was conducted.

SAMPLE 4

A magnesium alloy material (hereafter referred to as Sample 4) was cast by the use of the magnesium alloy B. Its forging rate was the same as in Sample 1.

SAMPLE 5

A magnesium alloy material (hereafter referred to as Sample 5) was cast by the use of the same magnesium alloy A as in Sample 1. Sample 5 is different from Sample 1 in that no forging was conducted.

TENSILE TEST

Figure 3:
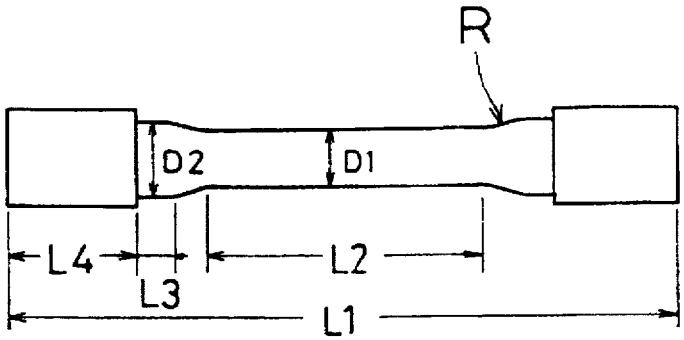
FIG. 3 is an elevation of a tensile test piece.

Samples 1 to 5 which were subjected to heat treatments were formed into respective tensile test pieces 6 in the shape of a bar as shown in FIG. 3. In the Figure, L1 is 42 mm, L2 is 17 mm, L3 is 2 mm, L4 is 8 mm, D1 is 4±0.03 mm, and D2 is 4.5 mm. A screw part of the test piece 6 is metric screw thread and has 6 mm diameter and 1.0 mm pitch.

Then, tensile test was conducted to the respective test pieces 6 of Samples 1 to 5 to measure tensile strength and 0.2% proof stress (that is, stress when permanent elongation is 0.2%). Test results is shown in the below Table 1.

Before the magnesium alloy material cast from the magnesium alloy B is forged, its average grain diameter was 125 to 285 μm (in detail, 125 μm in the vicinity of surface of the material and 285 μm at the center of the material). The average grain diameter is a little different in the vicinity of surface of the material and considerably different at the center of the material from the case of the magnesium alloy A. It can be understood that the large difference results from insufficient cooling speed at the time of casting.

TABLE 1

| | Mg alloy | forging rate (%) | forging limit (%) | heat treatment | tensile strength (MPa) | proof stress (MPa) |
|---|---|---|---|---|---|---|
| Sample 1 | A | 50 | 67 | T6 | 364 | 218 |
| Sample 2 | A | 65 | 67 | T6 | 372 | 242 |
| Sample 3 | B | 0 | 52 | T6 | 320 | 152 |
| Sample 4 | B | 50 | 52 | T6 | 358 | 208 |
| Sample 5 | A | 0 | 52 | T6 | 322 | 160 |

Figure 4:
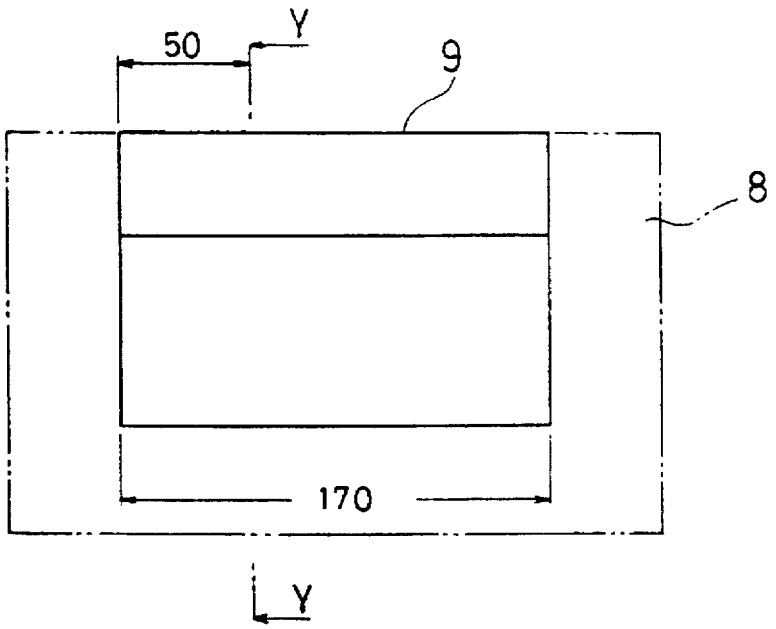
FIG. 4 is an elevation showing the form of a magnesium alloy material.
Figure 5:
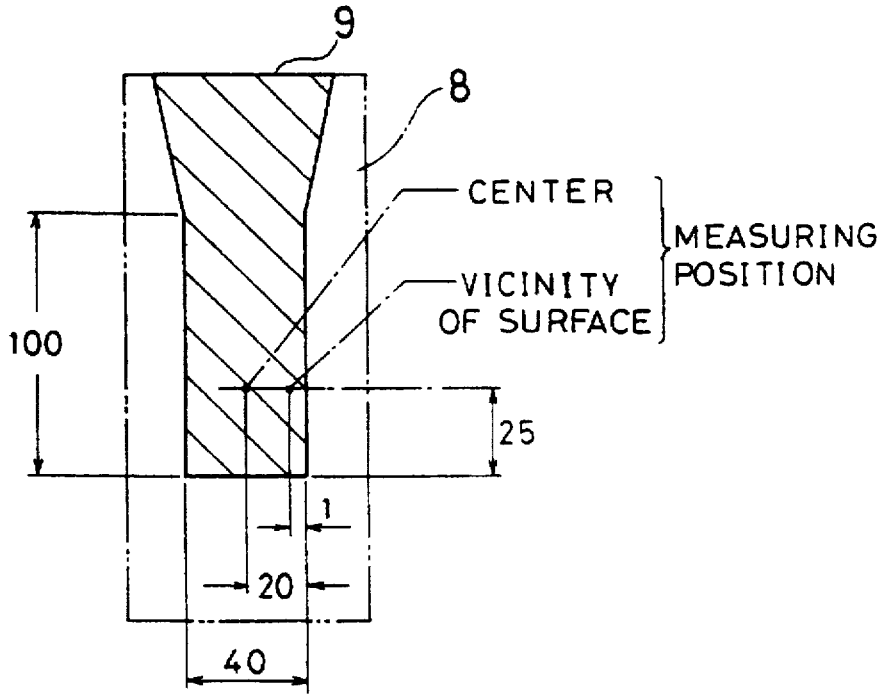
FIG. 5 is a sectional view taken on line Y—Y of FIG. 4.

FIG. 4 is a front view showing the cast material which has been cast by the use of the magnesium alloys A or B. FIG. 5 shows measuring positions when average grain diameters of cast magnesium alloy material 9 obtained from the magnesium alloys A or B are measured. In FIGS. 4 and 5, imaginary lines shown by two dots-dash line indicates an external form of a die 8 which is used at the casting of the magnesium alloy material 9.

Each test piece 6 used in the tensile test was cut out of the part relatively near to the surface of the material, that is, the part in which crystal grain is relatively fine, in either case where forging or no forging was conducted to the piece which was cut out of the magnesium alloy material 9. On the other hand. Samples for the purpose of measuring forging limit were cut out of the part relatively near to the center of the material 9. In other words, the Samples were cut out including the part in which crystal grain is relatively large.

TEST RESULTS

When the molten magnesium alloy containing strontium of 0.10 weight % is used for an alloy material, the forging limit is 67%. When the molten magnesium alloy containing strontium of 0.20 weight % is used, the forging limit is 52%. From this, it can be understood that forging formability is enhanced by using large amount of strontium. Conventionally, when molten magnesium alloy contains strontium of more than 0.02 weight %, grain refinement of a cast structure is saturated thereby preventing further grain refinement. In spite of this, Samples 1 and 2 by the use of the magnesium alloy A containing large amount of strontium excels, in forging formability, Samples 3 and 4 by use of the magnesium alloy B. From this, it can be understood that the strontium contributes to enhancement of forging formability because of not only the grain refinement effect thereof but also another effect, that is, an effect that the strontium existing at high density in the vicinity of grain boundary of the magnesium alloy reinforces the grain boundary thereby restraining cracks from generating in the grain boundary at the forming.

In general, in order that cast material is stably forged in a good state, there is necessary forging formability as forging limit of the cast material is over 60% as a reference value. In Samples 3, 4 using the magnesium alloy B which has small strontium content (0.02 weight %), however, the forging limit is considerably lower than the reference value. The reason for this can be understood as follows: because, as mentioned above, grain diameter at the center of the material cast from the magnesium alloy B is considerably larger (285 μm) as compared with the case of the magnesium alloy A, and in addition to this, Samples for the purpose of measuring forging limit were cut out including the part relatively near to the center of the material 9 and therefore includes the part in which crystal grain is relatively large (285 μm).

With reference to tensile strength and proof stress of Samples subjected to heat treatments, Sample 1 is higher in tensile strength and proof stress than all of Samples 3, 4 and 5. The reason why Samples 1 and 4 obtains better results than Samples 3 and 5 is that forming energy generated at forging was stored as distortion at the inside of the alloy material and the crystal grain was refined by the subsequent heat treatments.

Comparing Sample 1 with Sample 4, Sample 1 obtains better results than Sample 4, while both of them have the same forging rate. The reason for this can be understood as follows: because Sample 4 is lower in forging limit than Sample 1 and is forged to the vicinity of the forging limit, and because Sample 1 includes more strontium than Sample 4 and the strontium exists at high density in the vicinity of grain boundary of the magnesium alloy to reinforce the grain boundary thereby preventing progress of cracks generated along the grain boundary at the tensile test.

Further, Sample 2 obtains better results than Sample 1. It can be understood as the reason that Sample 2 is higher in forging rate than Sample 1.

Next, there will be discussed a relation between strontium content and crystal grain size in a magnesium alloy material.

DEVICES

Figure 6:
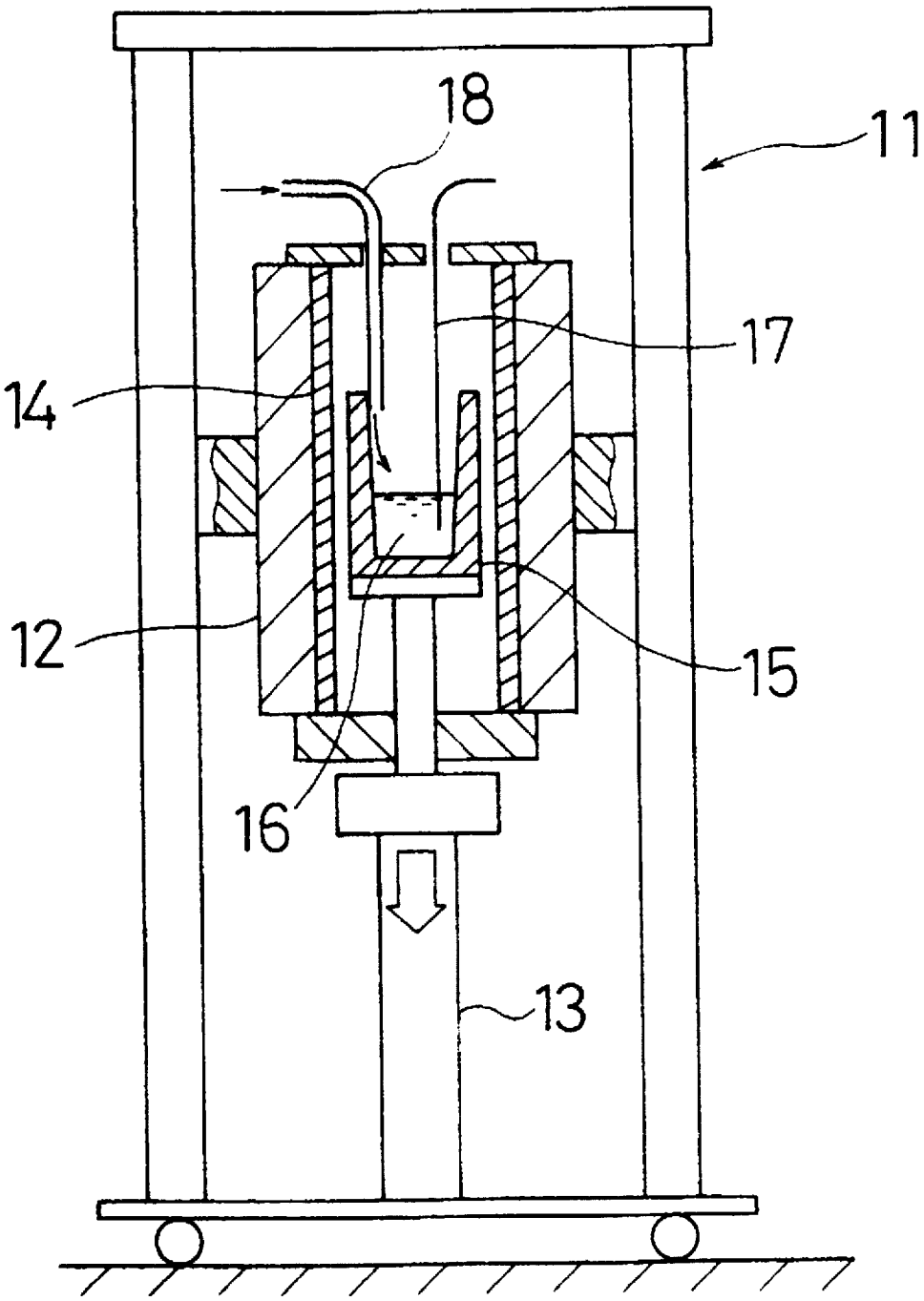
FIG. 6 is an elevation partly in section showing a melting device.

With reference to a melting device 11 shown in FIG. 6, disposed in a center part of a casing 12 is a cylindrical crucible 15 supported movably in a perpendicular direction by a cylinder 13. In the surroundings of the crucible 15, heaters 14 are arranged. The crucible 15 is formed by such as mild steel. The temperature of molten metal 16 in the crucible 15 can be measured by a thermocouple 17. Protection gas is supplied, from a gas supplying tube 18, to the surface of the molten metal 16 in the crucible 15.

Figure 7:
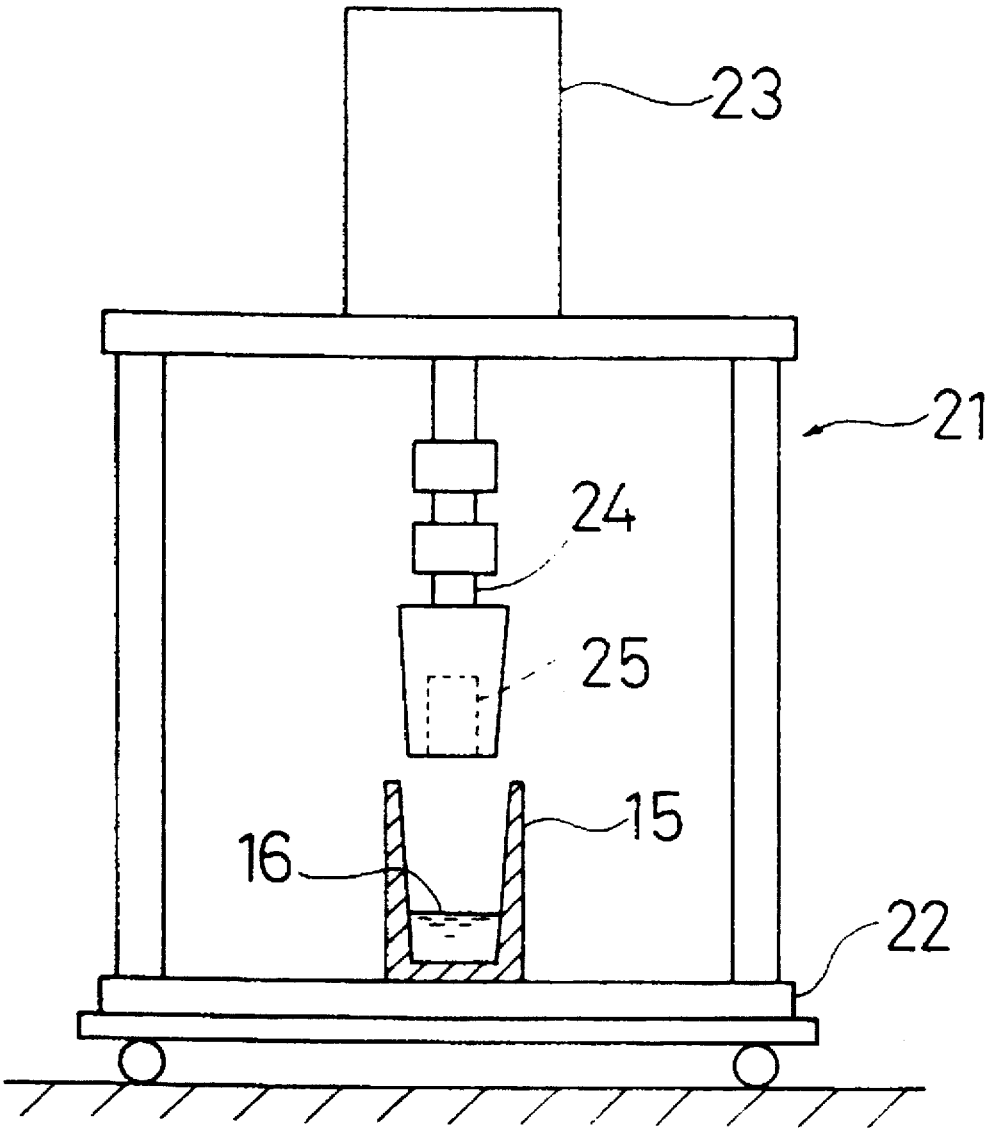
FIG. 7 is an elevation partly in section showing a casting device.
Figure 8:
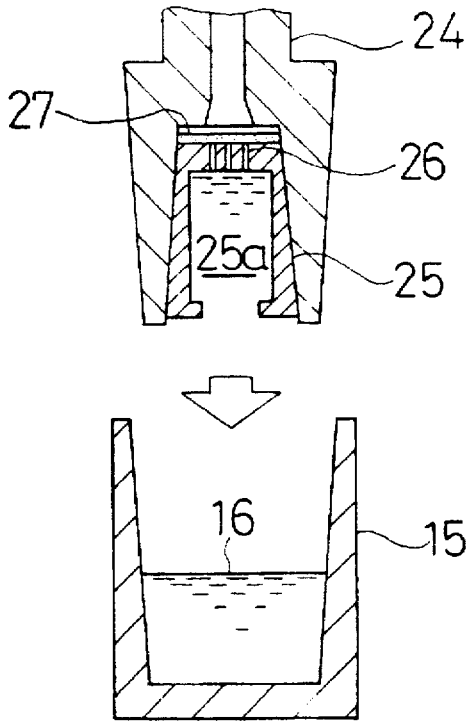
FIG. 8 is a sectional view showing one step of a casting process.

With reference to a casting device 21 shown in FIG. 7, a die 25 is disposed above a base 22. The die 25 is fixed to a lower end of a plunger 24 of a hydraulic cylinder 23. As shown in FIG. 8, at an upper part of the die 25, air vents 26, 26, . . . are formed. The air vents 26 are covered by porous metal (Ni) 27 in order to prevent melted material from blowing off.

Figure 9:
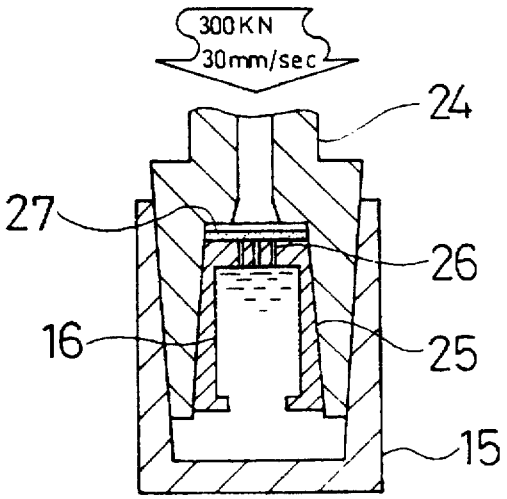
FIG. 9 is a sectional view showing another step of the casting process.
Figure 10:
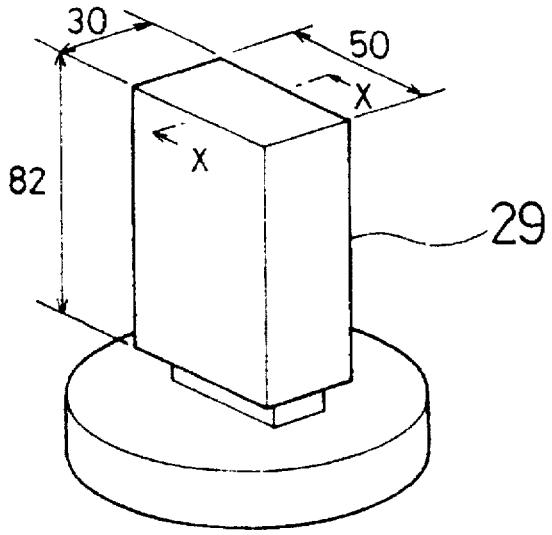
FIG. 10 is a perspective view of a material obtained by casting.

Under the above construction of the casting device 21, the crucible 15 in which molten metal 16 is entered is placed below the die 25. Then, the plunger 24 is moved downward at a set load and a set velocity. Thereby, as shown in FIG. 9, molten metal 16 is put into a cavity 25*a* of the die 25. As a result, a material (cast material) 29 as shown in FIG. 10 is obtained.

CASTING AND EXAMINATION

Each of Samples whose chemical components are shown in the below Table 2 was cast by the use of the above devices 11, 21. Molten alloy was put into a die 25 on condition that a load of the plunger 24 is 300 kN and a moving velocity thereof is 30 mm per second. Then, a relation between strontium content and crystal grain size in cast materials 29 obtained from the above Samples was examined.

TABLE 2

| | Sr | Al | Mn | Zn | Ni | Cu | Fe | Si | Mg |
|---|---|---|---|---|---|---|---|---|---|
| Sample 1 | 0 | 6.8 | 0.38 | 0.7 | 0.0005 | 0.001 | 0.001 | 0.02 | rest |
| Sample 2 | 0.02 | 7.1 | 0.50 | 0.8 | 0.0005 | 0.001 | 0.001 | 0.03 | rest |
| Sample 3 | 0.12 | 7.0 | 0.40 | 0.7 | 0.0005 | 0.002 | 0.001 | 0.03 | rest |
| Sample 4 | 0.20 | 7.2 | 0.40 | 0.7 | 0.0008 | 0.002 | 0.002 | 0.02 | rest |
| Sample 5 | 0.44 | 7.1 | 0.48 | 0.7 | 0.0004 | 0.001 | 0.001 | 0.03 | rest |
| Sample 8 | 0.51 | 7.1 | 0.50 | 0.7 | 0.0005 | 0.001 | 0.001 | 0.02 | rest |

In the above Table 2, each value of the chemical components is shown in unit of weight % and "rest" in Mg means the remainder percent when all of the other components percent are taken from 100.

Figure 11:
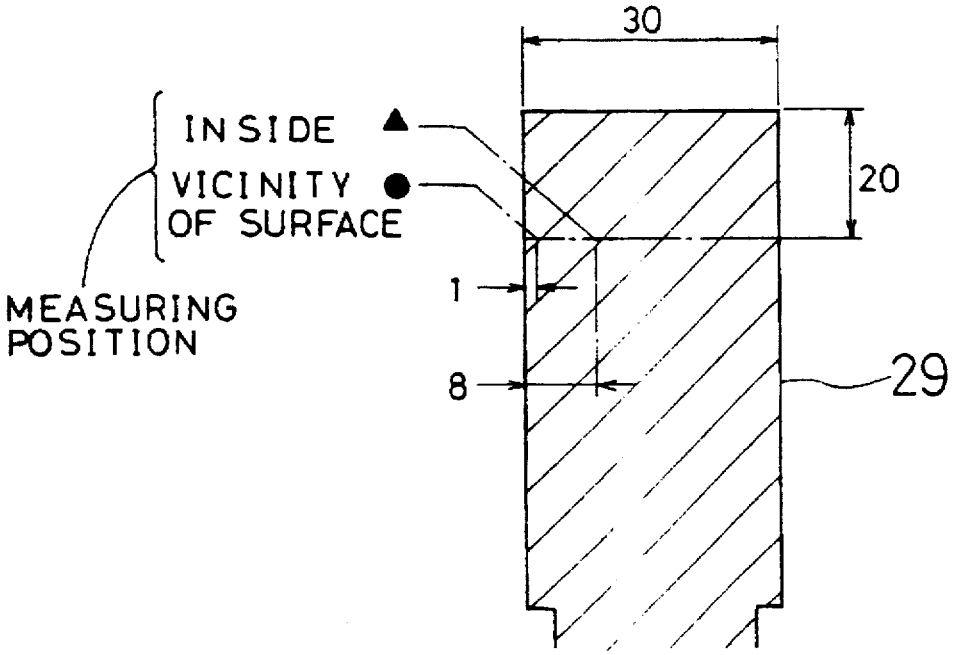
FIG. 11 is a sectional view taken on line X—X of FIG. 10.
Figure 12:
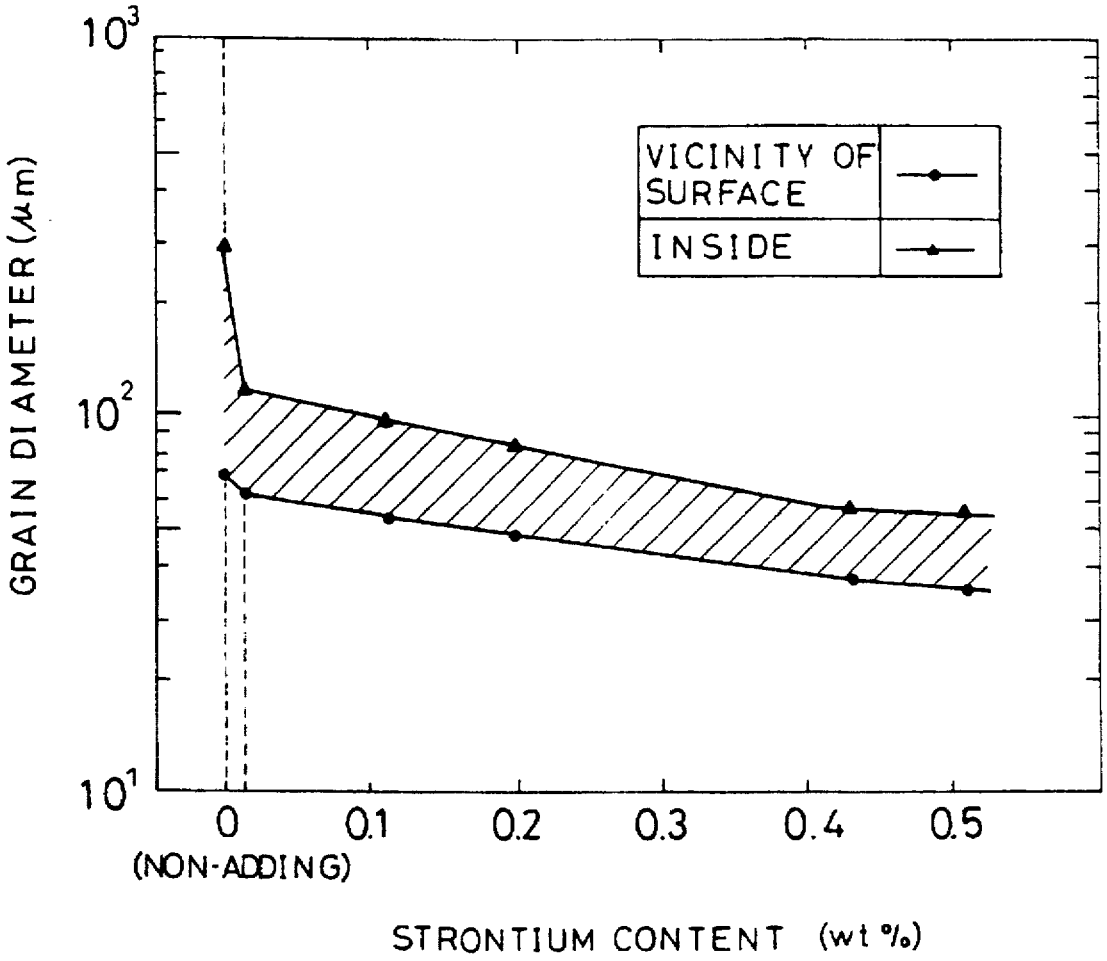
FIG. 12 is a graph showing a relation between grain size and strontium content of a magnesium light alloy product.

Examination results are shown in FIG. 12. In the graph of FIG. 12, a circular mark shows a crystal grain size in the vicinity of the surface of the cast material 29 and a triangular mark shows a crystal grain size at the inside of the cast material 29. FIG. 11 is a sectional view taken on line X—X of FIG. 10. In the Figure, respective measuring positions in the vicinity of the surface (corresponding to the circular mark) and at the inside (corresponding to the triangular mark) of the cast material 29 are shown.

As understood from the results shown in FIG. 12, in the cast material having no strontium, the grain is relatively small in the vicinity of the surface and large at the inside. In the cast material having strontium of more than 0.02 weight %, the grain is considerably refined not only in the vicinity of the surface but also at the inside. Even in the cast material having strontium of lower limit content (that is, 0.02 weight %), the grain size is below 20 μm.

The casting method using the device of FIG. 7 enables further rapid cooling speed than the above-mentioned casting method. Accordingly, even if alloy materials having same components are cast by both of the casting methods, obtained cast structures are different from each other. In other words, although the two alloy materials are different in its inside portion from each other, the alloy material obtained by using the device of FIG. 7 has a cast structure with smaller grain size.

Next, there will be discussed a relation between grain size and plastic formability in a magnesium alloy material.

A relation between grain size and plastic formability in a magnesium alloy material was examined.

A material to be forged with 28 mm diameter and 42 mm height was cast by the use of a magnesium alloy having chemical components shown in the below Table 3. Then, upsetting as one kind of forging was conducted to the cast material by the method shown in FIG. 2.

TABLE 3

| Al | Mn | Zn | Ni | Cu | Fe | SI | Mg |
|---|---|---|---|---|---|---|---|
| 6.0 to 9.0 | 0.20 to 0.25 | 0.55 to 0.60 | 0.001 | 0.005 | 0.002 | 0.040 | rest |

In the above Table 3, each value of the chemical components is shown in unit of weight % and "rest" in Mg means the remainder percent when all of the other components percent are taken from 100.

Then, as in the test of forging limit shown in Table 1, upsetting formability of the material to be forged was examined, by the use of the above formula (1), based on a compression allowance till a minute crack generated on the surface of the material to be forged when the material was gradually compressed (upset). In the above test, temperature of the material was set to 350° C., distortion speed at upsetting is low and no heat treatment was conducted to the material.

Figure 13:
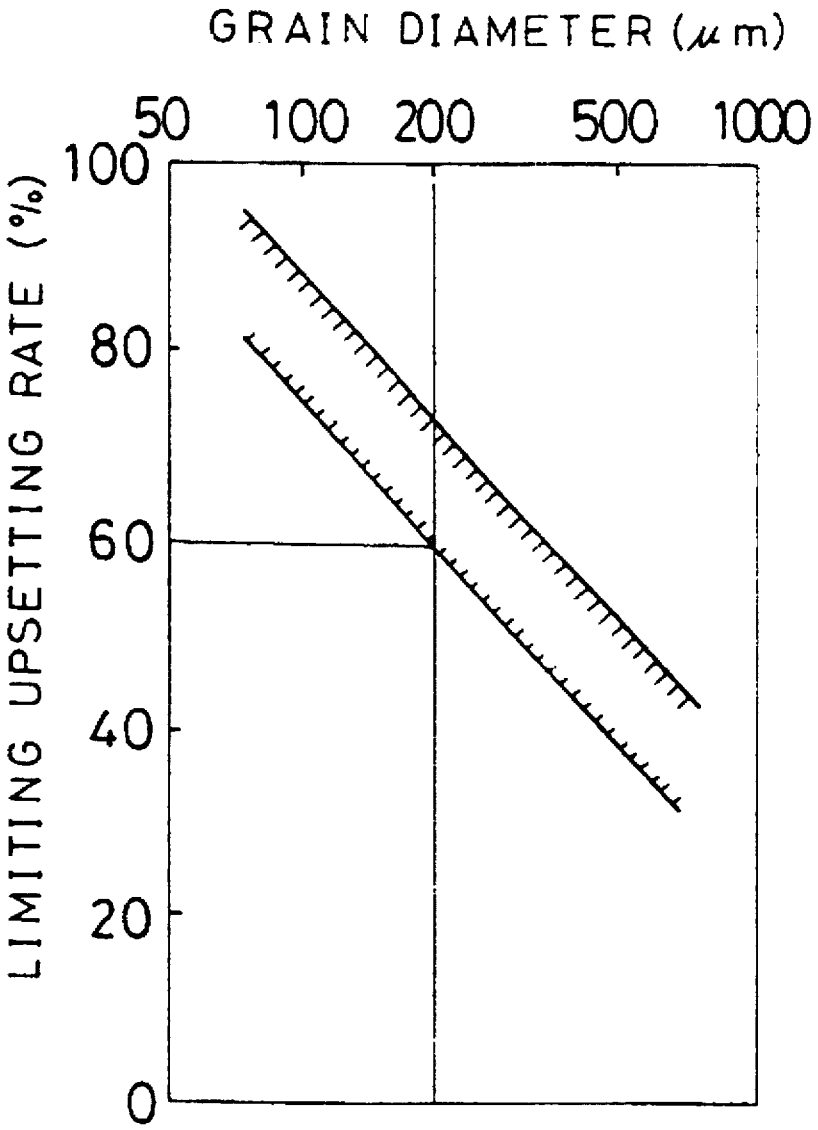
FIG. 13 is a graph showing a relation between grain size and plastic formability of a magnesium light alloy product.

The results of the test are shown in FIG. 13. In general, safe forging of cast material requires forging formability in which limiting upsetting rate is over 60%. From the results of FIG. 13, it is understood that, in order to obtain sufficient forging formability of the cast material, the grains are formed in average diameter below 200 μm, in other words, the crystal structure of the material is so refined that the grain size is below 200 μm.

Next, there will be discussed a relation between strontium content and corrosion resistance in a magnesium light alloy product.

Magnesium alloys containing respective set amount of strontium as shown in the below Table 4 were melted, and obtained molten magnesium alloys were cast and then forged on condition that the forging rate was 30%. Then, respective forged alloy materials were subjected to above-mentioned heat treatments and formed into board-shaped samples. The board-shaped sample has 50 mm width, 90 mm length and 5 mm thickness.

TABLE 4

| | Sr | Al | Mn | Zn | Ni | Cu | Fe | Si | Mg |
|---|---|---|---|---|---|---|---|---|---|
| Sample 1 | 0 | 6.8 | 0.38 | 0.7 | 0.0005 | 0.001 | 0.091 | 0.02 | rest |
| Sample 2 | 0.02 | 7.1 | 0.50 | 0.8 | 0.0005 | 0.001 | 0.001 | 0.03 | rest |
| Sample 3 | 0.12 | 7.0 | 0.40 | 0.7 | 0.0005 | 0.002 | 0.001 | 0.03 | rest |
| Sample 4 | 0.20 | 7.2 | 0.40 | 0.7 | 0.0008 | 0.002 | 0.002 | 0.02 | rest |
| Sample 5 | 0.44 | 7.1 | 0.48 | 0.7 | 0.0004 | 0.001 | 0.001 | 0.03 | rest |
| Sample 6 | 0.51 | 7.1 | 0.50 | 0.7 | 0.0005 | 0.001 | 0.001 | 0.02 | rest |

In the above Table 2, each value of the chemical components is shown in unit of weight % and "rest" in Mg means the remainder percent when all of the other components percent are taken from 100.

Obtained samples were subjected to corrosion test by spraying salt water on the following condition: testing temperature of 35° C., salt-water density of 5 weight %, two kinds of testing times of 1000 hours and 2000 hours.

Figure 14:
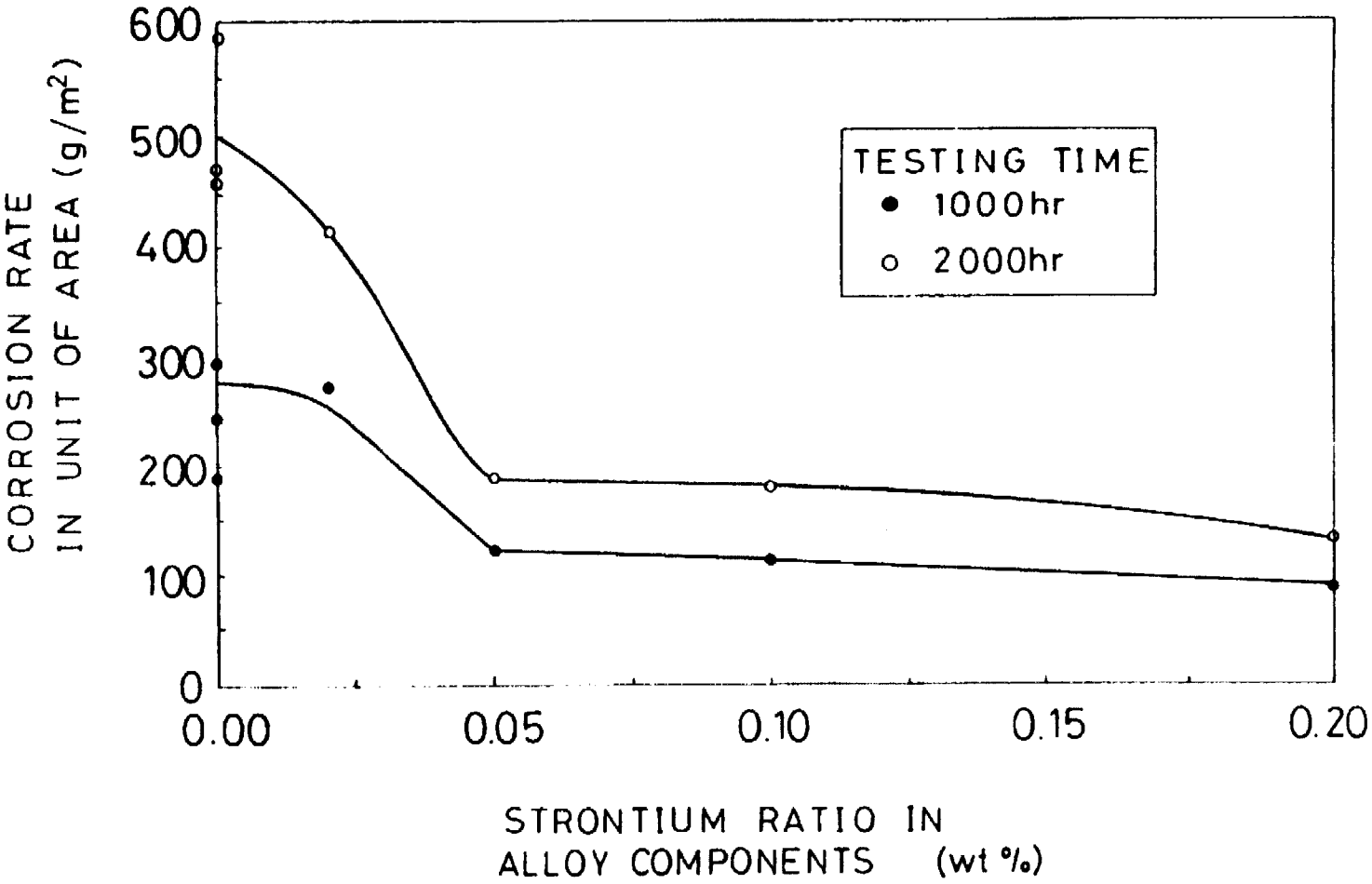
FIG. 14 is a graph showing a relation between corrosion resistance and strontium content of a magnesium light alloy product.

The test results are shown in FIG. 14. From the graph of FIG. 14, it is understood that as the strontium content increases, corrosion rate of the samples, i.e., amount reduced due to corrosion, lessens, and that adding strontium contributes to enhancement of corrosion resistance of a magnesium light alloy product.

There will be discussed a half-melting casting and forging method.

Figure 15:
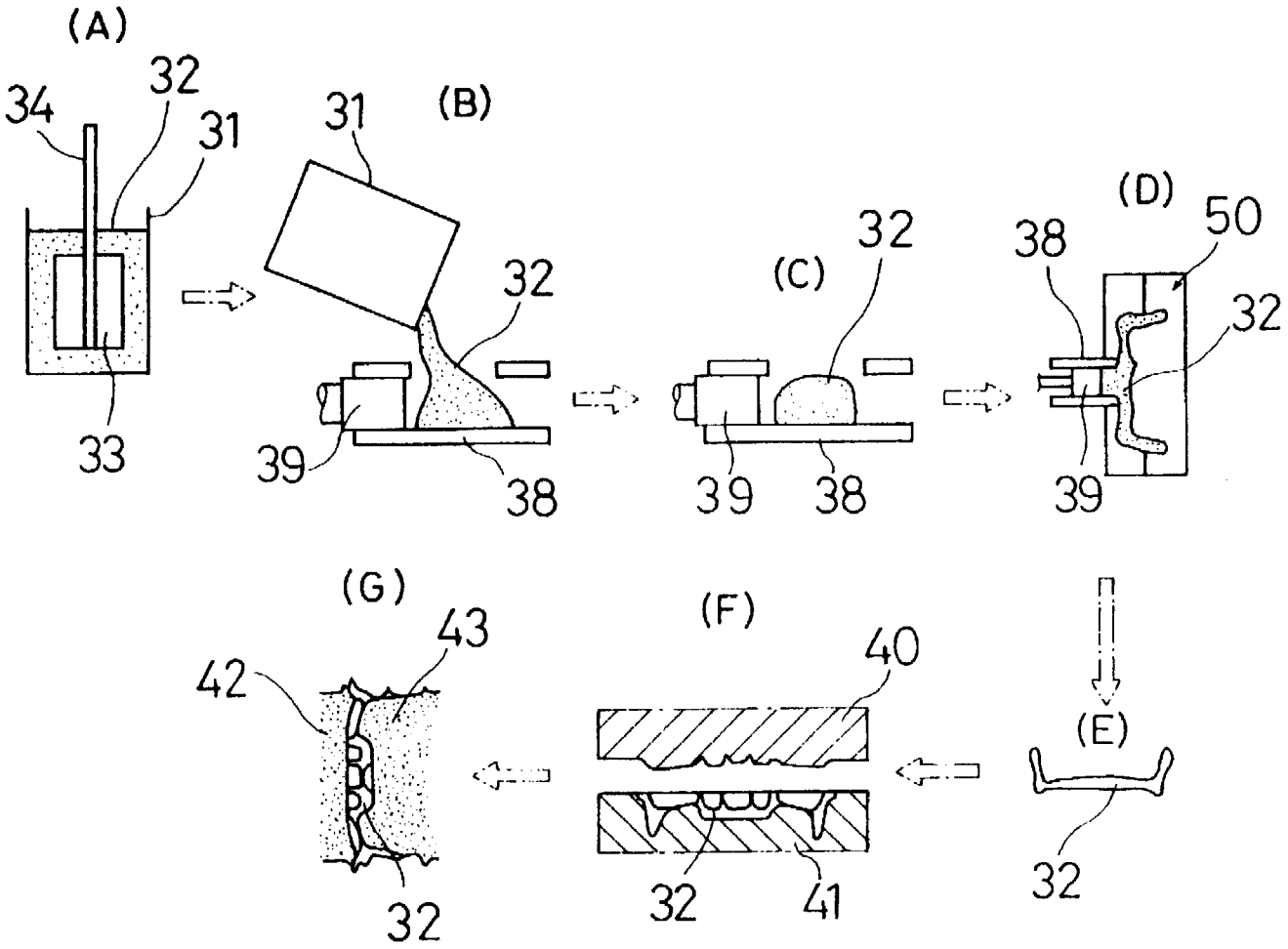
FIG. 15 is a producing step diagram showing each step of a method for producing a light alloy product.

(A) to (G) of FIG. 15 show respective processes of a producing method of a magnesium-light-alloy automobile part (wheel) based on a half-melting casting and forging method.

First Process (refer to FIG. 15 (A))

Figure 16:
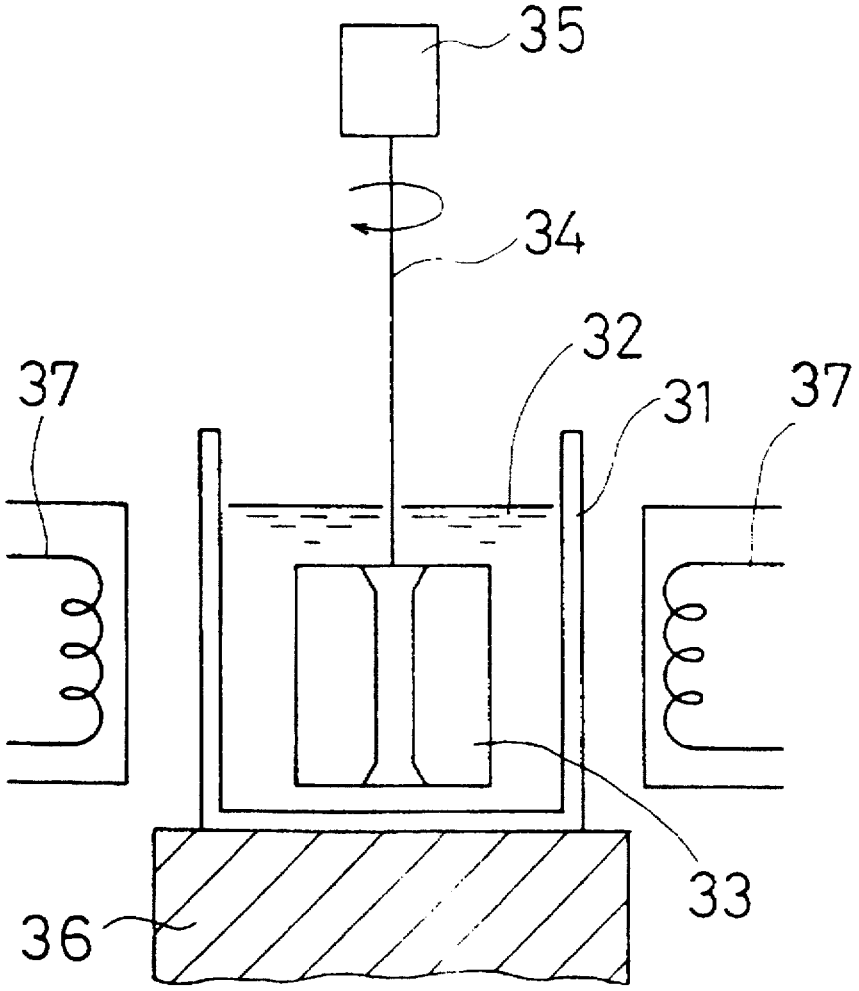
FIG. 16 is a sectional view showing a schematic structure of a producing device for carrying out the method of FIG. 15.
Figure 17:
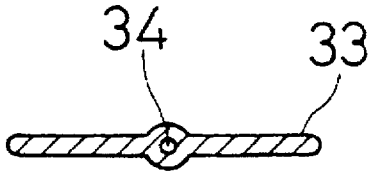
FIG. 17 is a sectional view of an elementary part of the producing device.

First, as shown in FIG. 16, magnesium alloy material (AZ80) 32 with chemical components shown in the below Table 5, which is light alloy material, is entered in a crucible 31 disposed on a stand 36 and heated by heaters 37, 37 from the surroundings thereby being in a half-melted state. Then, the magnesium alloy material is stirred and mixed, by rotating a stirring bar 34 having a stirring plate 33 as shown in FIGS. 16 and 17 with a motor 35, under condition shown in the below Table 6.

TABLE 5

| | Al | Zn | Mn | Si | Cu | Ni | Fe |
|---|---|---|---|---|---|---|---|
| AZ80 | 8.0 | 0.67 | 0.21 | 0.042 | 0.005 | 0.001 | 0.002 |
| applicable range of AZ80 | 7.8 to 9.2 | 0.2 to 0.3 | 0.12 to 0.35 | 0.1 and less | 0.05 and less | 0.005 and less | 0.005 and less |

TABLE 6

| | solid-phase rate (%) | | |
|---|---|---|---|
| | 0 | intermediate rate | 60 |
| temperature of molten alloy (°C.) | 620 | Intermediate solid-phase rate is arbitrarily set in accordance with temperature of molten alloy. | 592 |
| stirring speed (rpm) | 300 | 300 | 300 |
| stirring time (min.) | 10 | 10 | 10 |

Figure 18:
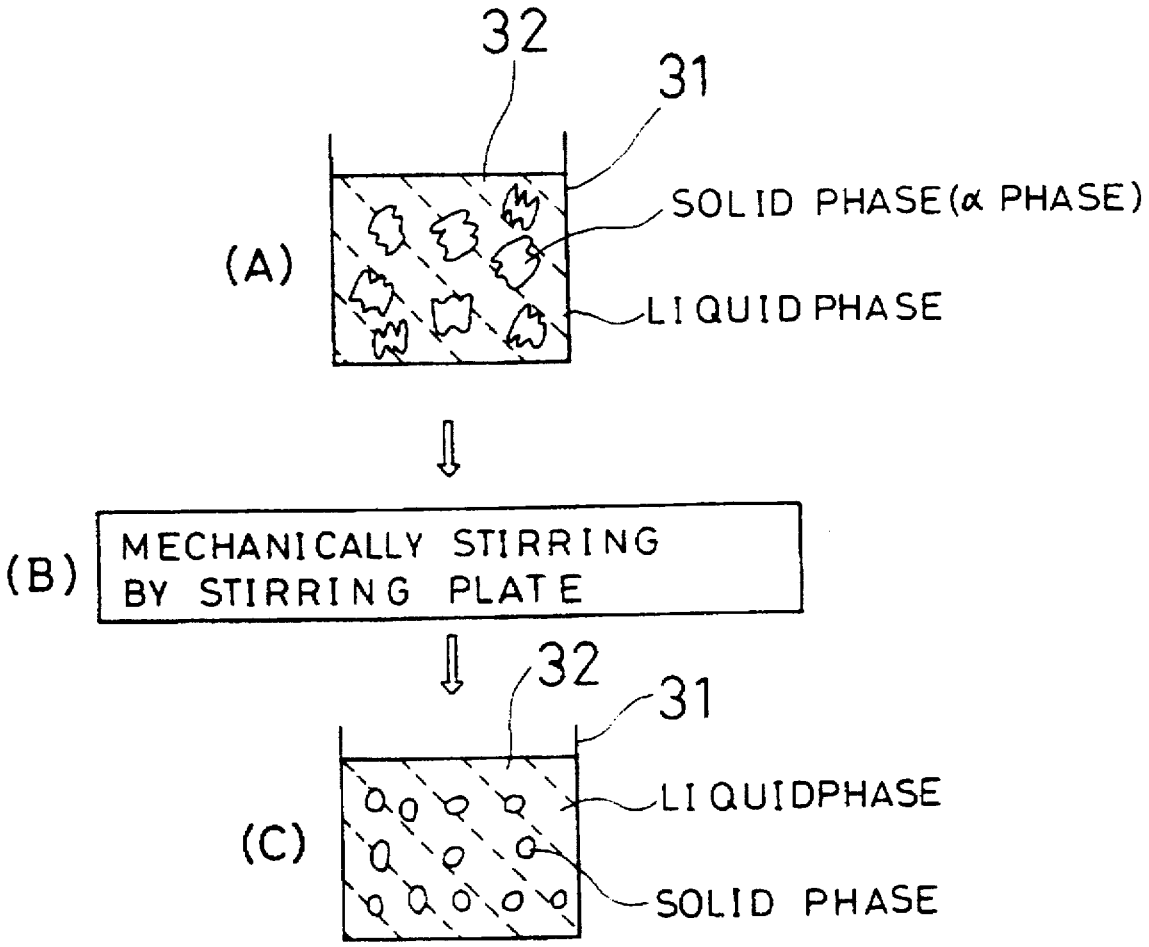
FIG. 18 is a diagram showing a phase transition of an alloy material at the time of stirring the alloy material in the producing step of FIG. 15.

Detailed description is made next about heating and stirring the magnesium alloy material 32 in the crucible 31 at the above first process, with reference to FIG. 18 (A), (B), (C). Initially, the material 32 is heated to the temperature at which the material 32 becomes an intermediate state between solid phase (α phase) and liquid phase (see FIG. 18 (A)). Then, the material 32 in the intermediate state is forced into stirring by the stirring plate 33 on the condition shown in Table 5 (see FIG. 18 (B)). Consequently, as shown in FIG. 18 (C), dendrite in solid phase of the material 32 is fractured to be spherical. At this time, solid-phase rate of the material 32 should be preferably set to 25 to 60% as below-mentioned.

Second Process (FIG. 15 (B), (C))

Next, the alloy material 32 in a half-melted state in the crucible 31, whose solid-phase rate is set to 25 to 60%, is put into a sleeve 38 for die casting having a plunger 39 so as to turn into a state of FIG. 15 (C) from that of FIG. 15 (B).

Third Process (FIG. 15 (D))

Then, the sleeve 38 is engaged to an inlet of a die 50 and the alloy material 32 in a half-melted state is put into the die 50 by actuating the plunger 39, so that the material 32 is cast (formed into a blank).

Fourth Process (FIG. 15 (E))

The alloy material 32, which is an intermediate product cast in the above manner, is taken out of the die 50.

Fifth Process (FIG. 15 (F))

The alloy material 32 which is an intermediate product cast in the above manner is set, as a material to be forged, on a bottom part 41 of a forging die and forged one time between the bottom part 41 and a top part 40 of the forging die thereby enhancing its mechanical strength.

Sixth Process (FIG. 15 (G))

Then, the alloy material 32 is subjected to heat treatments, for example, a solution treatment at 400° C. for four hours including later air-cooling and an artificial aging treatment at 180° C. for fifteen hours including later air-cooling, and details of the alloy material 32 are subjected to spinforging (spinning), so that a final product 32 is formed.

WORKING LIMIT MEASURING TEST

Next, a cylindrical test piece for compression test with, for example, 15 mm diameter and 30 mm length is formed from the final product obtained by the above processes. The test piece was subjected to a compression test by the use of a compression test device shown in FIG. 2.

Figure 19:
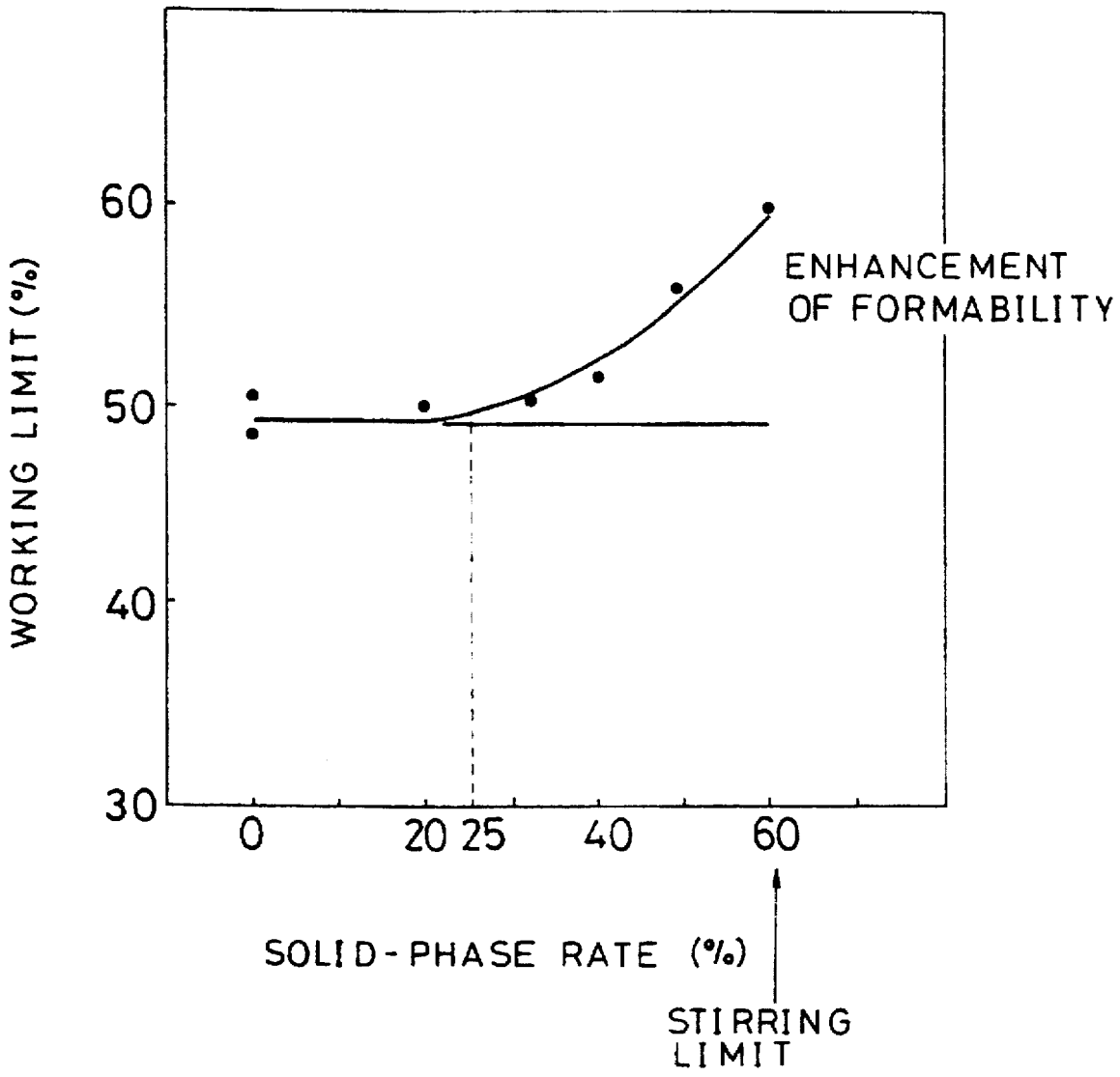
FIG. 19 is a graph showing a characteristic of an alloy material according to a relation between solid-phase rate and formability of the alloy material.

Based on data obtained from the results of the above test, there was obtained a relation between solid-phase rate and working limit of the alloy material 32 in a half-melted state, as shown in FIG. 19.

From FIG. 19, it is understood that, according to the half-melting casting method of the present embodiment, the alloy material having a solid-phase rate of more than 25% sufficiently excels in working limit to an alloy material having a solid-phase rate of 0% (i.e.., the material having a liquid-phase rate of 100% which is obtained by a normal melting casting method).

Figure 20:
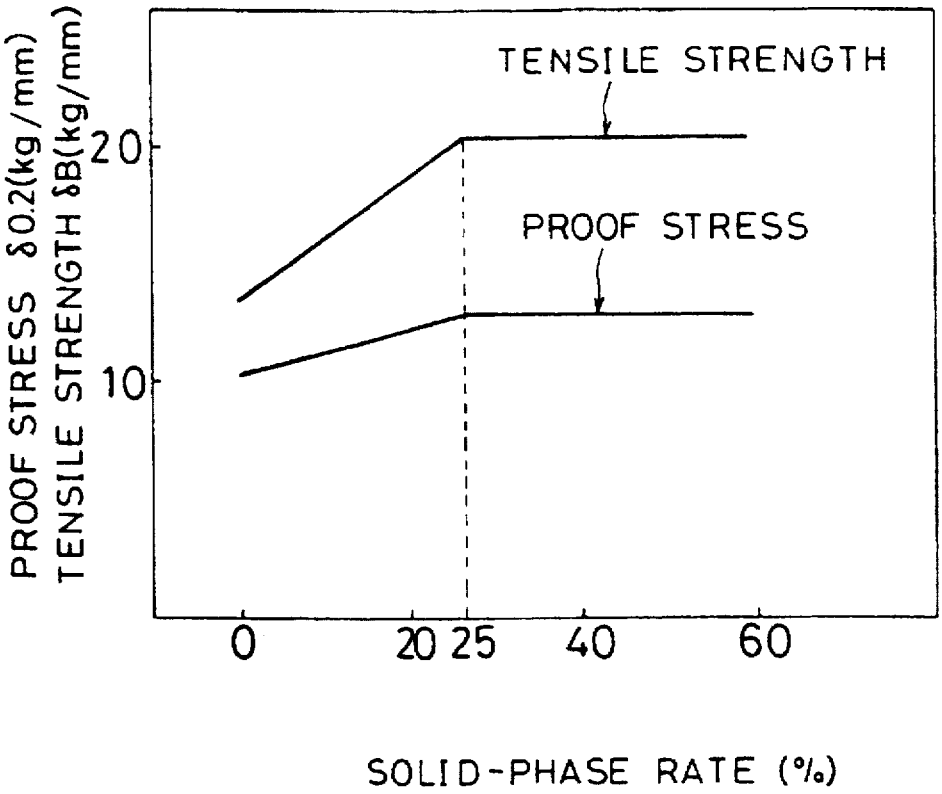
FIG. 20 is a graph showing a relation between solid-phase rate and tensile strength and a relation between solid-phase rate and proof stress, based on test results of FIG. 19.
Figure 21:
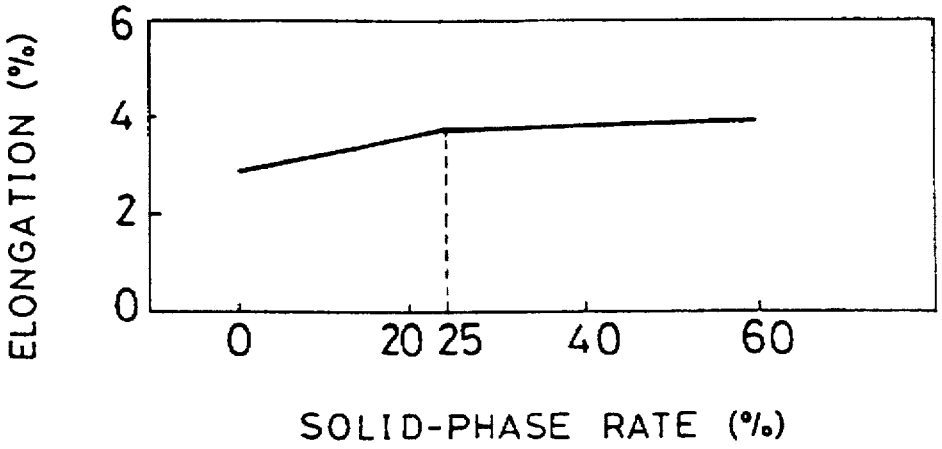
FIG. 21 is a graph showing a relation between solid-phase rate and elongation based on test results of FIG. 19.
Figure 22:
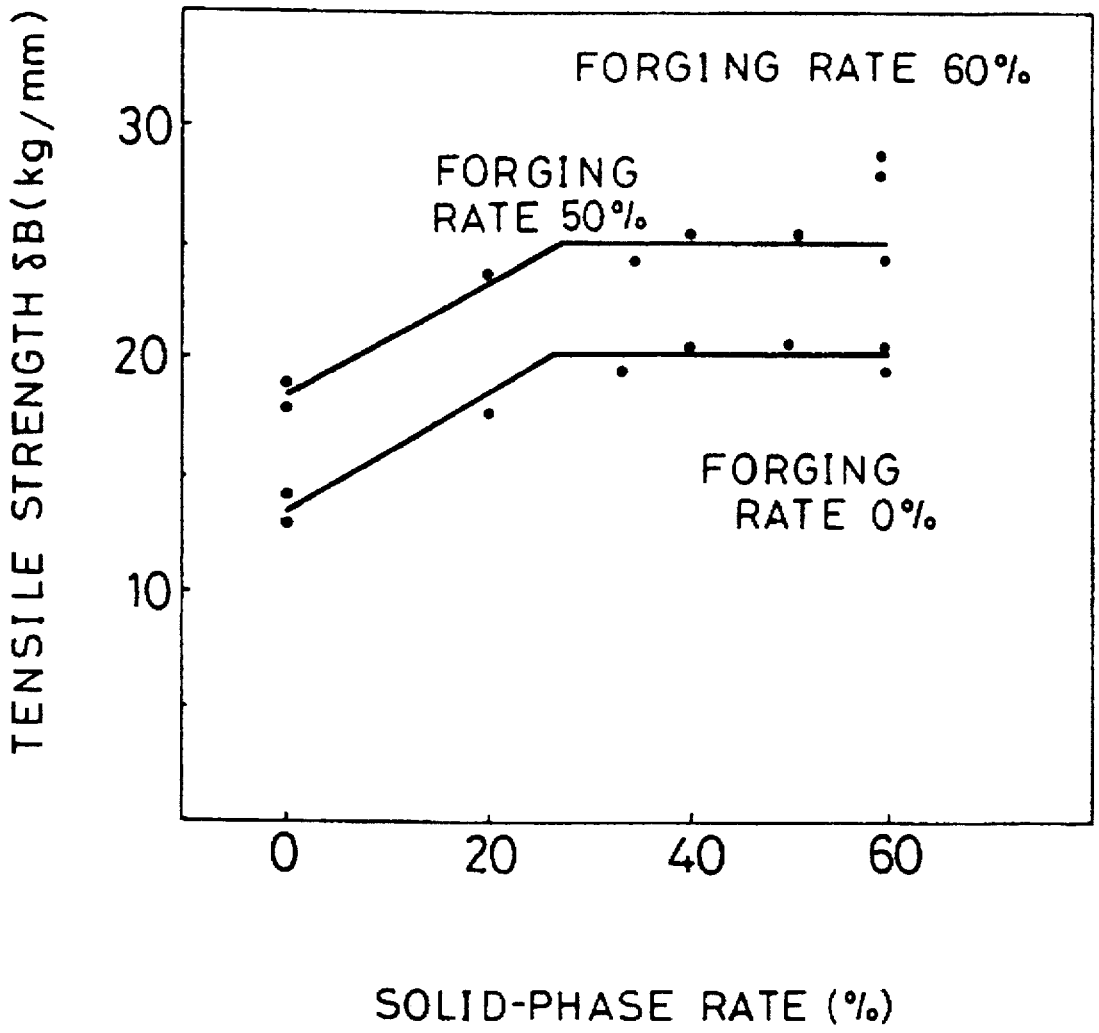
FIG. 22 is a graph showing a forging effect seen from a relation between solid-phase rate and tensile strength based on test results of FIG. 19.

Further, since the magnesium alloy obtained by the half-melting casting are more excellent in mechanical properties than that obtained by the conventional casting, the subsequently forged magnesium alloy enhances its formability (see FIGS. 20, 21 and 22).

When the solid-phase rate of the material is over 60%, however, fluidity of the alloy material is substantially deteriorated and casting defects such as a cavity are easily generated. Accordingly, as mentioned above, 25 to 60% is a range of suitable solid-phase rate of the alloy material 32 in a half-melted state.

Figure 23:
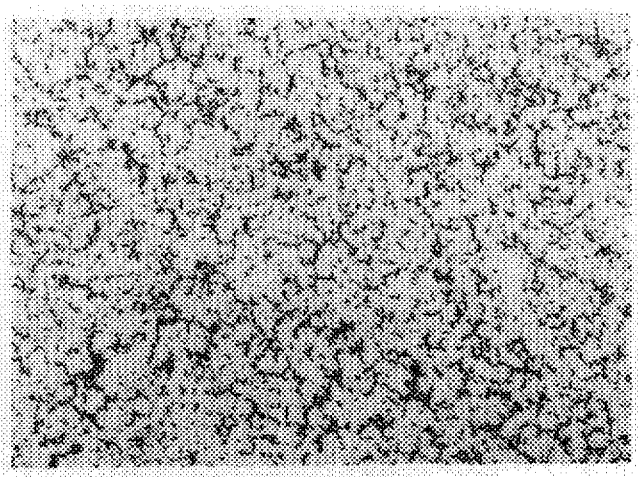
FIG. 23 is an enlarged photograph showing crystal structure of a magnesium alloy product which is obtained from a magnesium alloy material of a solid-phase rate of 26% (magnification: 100).
Figure 24:
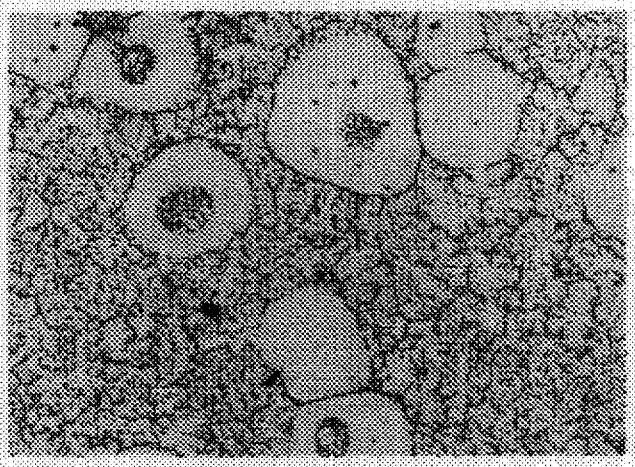
FIG. 24 is an enlarged photograph showing crystal structure of a magnesium alloy product which is obtained from a magnesium alloy material of a solid-phase rate of 59% (magnification: 100).
Figure 25:
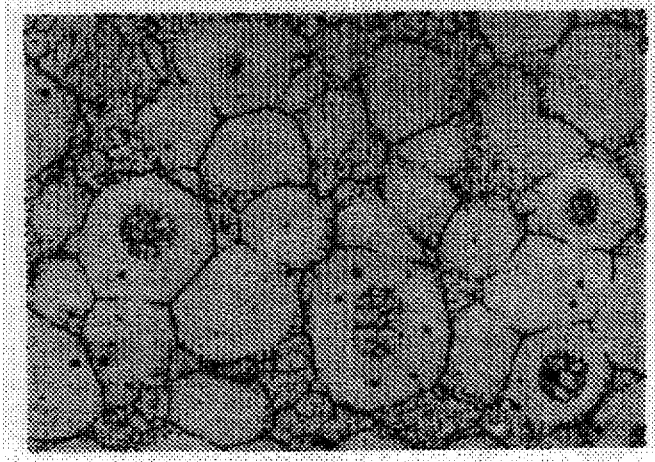
FIG. 25 is an enlarged photograph showing crystal structure of a conventional magnesium alloy product which is obtained from a magnesium alloy material of a solid-phase rate of 0% (magnification: 100).

FIGS. 23 and 24 show enlarged photographs of crystal structures of magnesium alloy products with 26% solid-phase rate and 59% solid-phase rate, respectively, the magnesium alloy products being produced according to the above-mentioned processes (without heat treatments). FIG. 25 shows an enlarged photograph of a crystal structure of a conventional magnesium alloy product with 0% solid-phase rate, i.e., 100% liquid-phase rate (produced without heat treatments). As understood from comparison between FIGS. 23, 24 and 25, in the alloy products of FIGS. 23 and 24 of the present embodiment in which solid-phase rates of the alloy materials are kept within 25 to 60%, dendrite in solid phase of the alloy material is fractured to turn into spheres (white parts in the Figures) by stirring the alloy material in its half-melted state. That is, in addition to enhanced working limit owing to existence of solid phase, excellent forging formability can be achieved because the solid phase is turned into spheres from dendrite. Further, because of enhanced working limit and excellent forging formability, the alloy material of the present embodiment is sufficiently enhanced in mechanical properties such as tensile strength by one time forging.

Furthermore, as understood from FIGS. 23 and 24, the magnesium alloy product of the present embodiment generates no cavity, as in the case of FIG. 25 in which the solid-phase rate of the magnesium alloy material is 0%.

It will be obvious to those skilled in the art that many modifications may be made within the scope of the present invention, and the invention includes all such modifications.

We claim:

1. A method of manufacturing a magnesium light alloy product, comprising the steps of:

stirring a magnesium alloy material in a semi-solid state in which a solid phase and a liquid phase exist;

casting the magnesium alloy material of semi-solid state into a mold to obtain a cast material;

forging the thus obtained casted material into a set shape at a temperature lower than the melting point of the magnesium alloy material.

2. The method of manufacturing a magnesium light alloy product of claim 1, wherein the magnesium alloy material of semi-solid state is in a state not exceeding 60% solid phase.

3. The method of manufacturing a magnesium light alloy product of claim 2, wherein the magnesium alloy material of semi-solid state is in a state of more than 25% solid phase.

4. The method of manufacturing a magnesium light alloy product of claim 2, further comprising the step of conducting T6 treatment after the forging step.

5. The method of manufacturing a magnesium light alloy product of claim 3, further comprising the step of conducting T6 treatment after the forging step.

6. The method of manufacturing a magnesium light alloy product of claim 4, wherein the magnesium light alloy product is a wheel for a vehicle.

7. The method of manufacturing a magnesium light alloy product of claim 5, wherein the magnesium light alloy product is a wheel for a vehicle.

8. A method of manufacturing a magnesium light alloy product, comprising the steps of:

stirring a magnesium alloy material in a semi-solid phase in which a solid phase and a liquid phase exist;

casting the magnesium alloy material of semi-solid phase into a mold to obtain a cast material;

putting out the thus obtained casted material from the mold and setting into a forging die; and forging the casted material into a set shape at a temperature lower than the melting point of the magnesium alloy material.

9. The method of manufacturing a magnesium light alloy product of claim 8, wherein the casted material obtained by the casting step has a primary shape corresponding to an intermediate product of the shape of the magnesium light alloy product.

10. The method of manufacturing a magnesium light alloy product of claim 8, wherein the forging rate in the forging step is at least 50%.

* * * * *

UNITED STATES PATENT AND TRADEMARK OFFICE

CERTIFICATE OF CORRECTION

PATENT NO. : 5,800,640

DATED : September 1, 1998

INVENTOR(S) : Yukio Yamamoto, Makoto Fujita, Nobuo Sakate, Katsuya Ohuchi and Shoji Hirabara It is certified that error appears in the above-indentified patent and that said Letters Patent is hereby corrected as shown below:

TITLE PAGE:

Replace item # 73 with the following:

--[73] Assignee: Mazda Motor Corporation, Hiroshima, Japan--

Signed and Sealed this

Thirty-first Day of August, 1999

*Attest:*

*Attesting Officer*

Q. TODD DICKINSON

*Acting Commissioner of Patents and Trademarks*